US005169029A

United States Patent [19]

Behar et al.

[11] Patent Number: 5,169,029

[45] Date of Patent: Dec. 8, 1992

[54] MIXING DISPENSER AND METHOD OF USING SAME

[75] Inventors: Alain Behar; Jean L. Bougamont, both of Eu, France

[73] Assignee: Societe Francaise d'Aerosols et de Bauchage, Friville-Escarbotin, France

[21] Appl. No.: 708,654

[22] Filed: May 31, 1991

[30] Foreign Application Priority Data

May 31, 1990 [FR] France ..... 90 06809

[51] Int. Cl.[5] ..... B67B 7/00

[52] U.S. Cl. ..... 222/1; 222/135; 222/145; 222/162; 222/163; 222/183; 222/255; 222/283; 222/309; 222/321; 222/325; 222/402.13; 239/304; 239/333; 239/353

[58] Field of Search ..... 222/1, 131, 135, 145, 222/182, 162, 163, 255, 283, 285, 286, 321, 309, 375, 379, 383, 385, 183, 402.13, 325; 604/191; 239/304, 333, 353, 337

[56] References Cited

U.S. PATENT DOCUMENTS

| | | | |
|---|---|---|---|
| 2,197,763 | 4/1940 | Kahn | 222/131 X |
| 3,613,956 | 10/1971 | McCulloch | 222/145 X |
| 3,760,986 | 9/1973 | Castner et al. | 222/255 X |
| 3,796,352 | 3/1974 | Morane | 222/135 |
| 4,006,841 | 2/1977 | Alticosalian | 222/42 |
| 4,238,055 | 12/1980 | Staar | 222/162 |
| 4,549,674 | 10/1985 | Alticosalian | 222/135 X |
| 4,773,562 | 9/1988 | Gueret | 222/135 |
| 4,902,281 | 2/1990 | Avoy | 222/255 X |
| 4,969,579 | 11/1990 | Behar | 222/136 |
| 5,002,048 | 3/1991 | Makiej, Jr. | 222/135 X |
| 5,042,693 | 8/1991 | DeLuca | 222/145 |

FOREIGN PATENT DOCUMENTS

| | | | |
|---|---|---|---|
| 0379627 | 8/1990 | European Pat. Off. | 222/255 |
| 0403417 | 12/1990 | European Pat. Off. | 239/304 |
| 416340 | 1/1967 | Switzerland | 239/304 |
| 1034528 | 11/1962 | United Kingdom . | |

*Primary Examiner*—Gregory L. Huson
*Attorney, Agent, or Firm*—Pennie & Edmonds

[57] ABSTRACT

An apparatus and method for storing and mixing components for forming a product and dispensing the resultant product. The apparatus comprises a dispensing head, a first cartridge for storing a first fluid component, and a second cartridge for storing a second fluid component. The first cartridge and the second cartridge each have a first open end and a second closed end. A first distributor provides fluid communication between the first cartridge and the dispensing head, and a second distributor provides fluid communication between the second cartridge and the dispensing head. Both the first and second distributors have a preselected effective stroke distance. A compensating assembly is also provided. A housing maintains the dispensing head, first cartridge, second cartridge, first distributor, second distributor, and compensating assembly in operative relation with each other. Upon movement of the dispensing head and housing toward each other, the compensating assembly will yield to reduce the stroke of the first distributor. Thus, the firt component and the second component are mixed in a preselected proportion within the dispensing head to form a resultant product and the product is subsequently discharged from the dispensing head.

29 Claims, 7 Drawing Sheets

IV
II
6
6
3
II
2
2a
4
5
100
1
III
III
6a
IV

Fig. 2
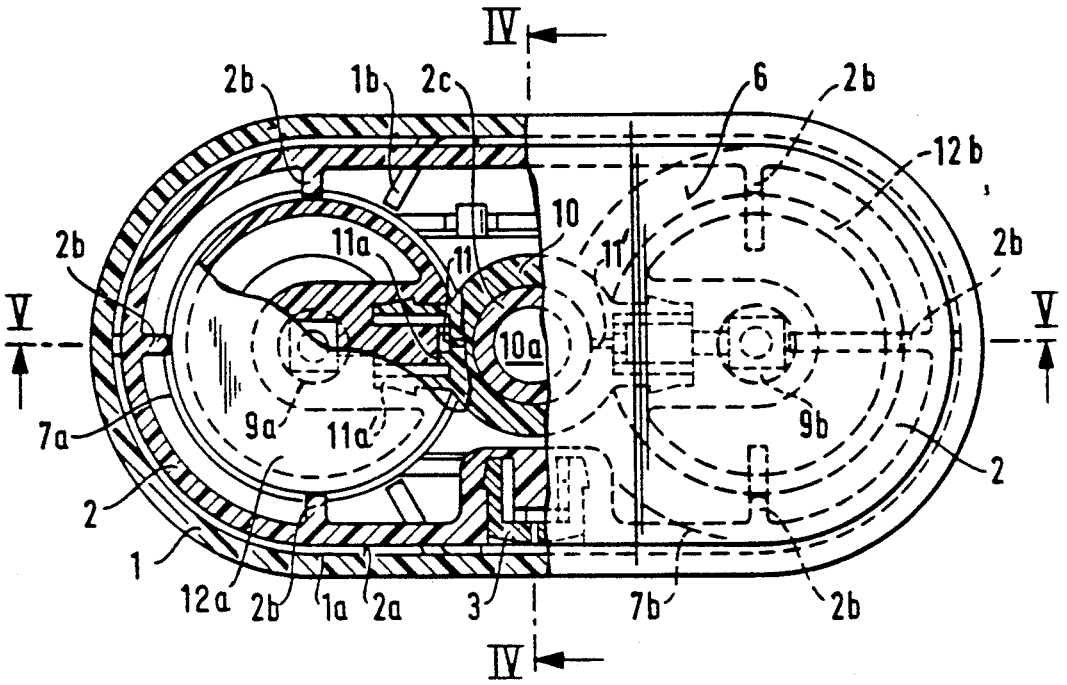
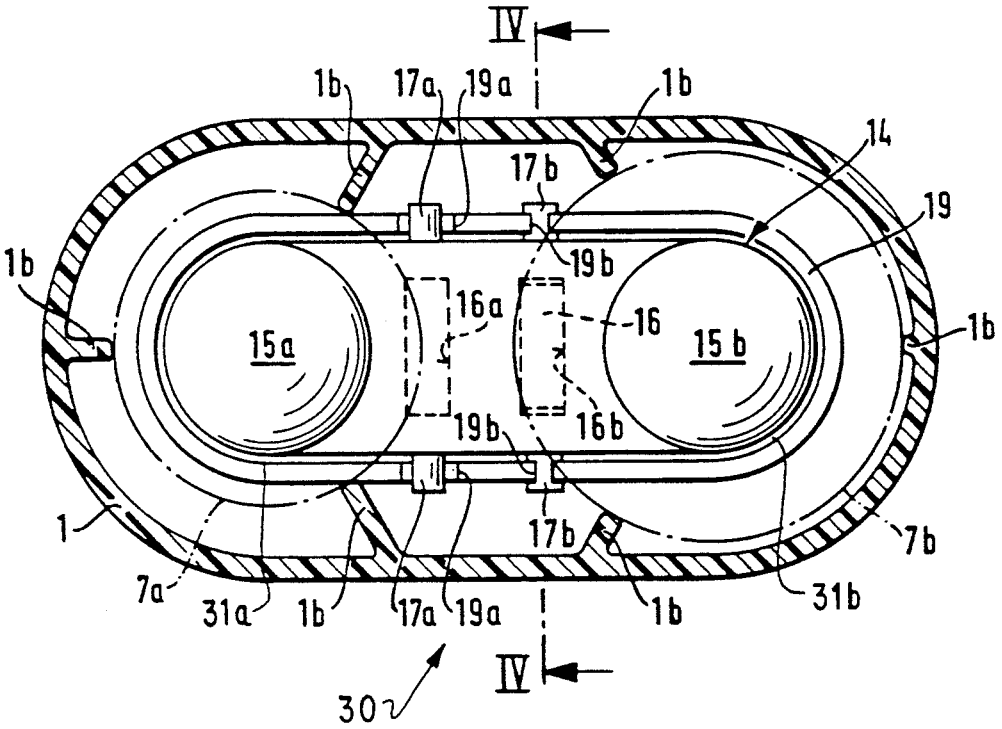
Fig. 3

100
2d
2c
10
6
2b
2
11a
11b
10a
12b
12a
11
13a
13b
2a
2b
11a'
11b'
9a
9b
1a
4
8a
8b
5
1b
1
7b
7a
30
19b
15a
16a
16b
15b
31a
19a
19
18a
18b
31b
17a
16
17b
14

100
2d
2c
10
6
2b
2
11a
11b
10a
11
9a
9b
12a
12b
1a
13a
11a
11b
13b
2a
4
5
1b
7a
7b
1
1b
30
15a
19b
16b
15b
16a
19
31a
18a
17a
19a
16
17b
18b
31b
14

MIXING DISPENSER AND METHOD OF USING SAME

BACKGROUND OF THE INVENTION

1. Field of Invention

This invention relates to an apparatus for storing and transporting separate components combinable to form a mixture or resultant product and thereafter dispensing the mixture or product thus produced. In particular, the invention relates to an apparatus for mixing two components in a set proportion just prior to dispensing the resultant mixture or product and then dispensing this material. This invention also relates to a method for using the apparatus.

2. Description of the Prior Art

It is well known that many products comprising only a single component are sold commercially in vessels equipped with a manual dispenser which permit the product to be discharged in a desired quantity. Such products are usually discharged by a simple pumping action or through the use of a propellant gas, i.e., an aerosol. Frequently, such vessels contain a perfume or a medicament which is used in very small doses. The components of such dispensers are fairly well standardized, and most simply employ different types of valves or pumps.

In the chemical industry, particularly in the cosmetic and pharmaceutical fields, a vast amount of complex and unstable products comprising more than one component have been and are being developed. These components, when stored individually, are usually very stable and may be stored for a relatively long period of time. However, when the components are combined to form the product, the properties of the product usually change dramatically as time passes. Thus, these products must be prepared as late as possible before use. The development of such multicomponent products has led to the development of various types of dispensers capable of mixing the two components which are otherwise maintained in separate vessels until just prior to use. These dispensers usually comprise twin parallel containers and the components within these containers are mixed while they are being dispensed from a single nozzle. One example of such a dispenser is disclosed by U.S. Pat. No. 4,969,579 to Behar. Other dispensers are disclosed in U.S. Pat. Nos. 4,773,562 to Gueret and 4,006,841 to Alticosalian, and French patent No. 1,353,494.

One drawback to the use of the prior art dispensers described above, however, relates to instances where a portion of one component must be mixed with a smaller or larger portion of a second component. In many applications, the ratio of the two partial doses could exceed five-to-one, thereby necessitating the same ratio in the capacities of the distributors and containers acting in parallel to dispense the components in a five-to-one ratio. However, the prior art dispensers cannot easily discharge the components in anything other than a one-to-one ratio.

SUMMARY OF THE INVENTION

In accordance with the present invention, there is provided an apparatus for storing and mixing the components of a final mixture or product and for dispensing the mixture or product thus produced. The apparatus comprises a dispensing head within which the components are mixed and through which the product is dispensed. A first cartridge member and a second cartridge member store the fluid components. The first cartridge and the second cartridge each have a first open end and a second closed end. A first distributor, which is preferably a pump, provides fluid communication between the first cartridge and the dispensing head, and a second distributor, e.g., a second pump, provides fluid communication between the second cartridge and the dispensing head. Both the first and second distributors have a preselected effective stroke distance. A compensating assembly, comprising a lever positioned on a fulcrum offset from the center of the lever, thereby providing the lever with a longer lever arm and a shorter lever arm, is utilized to distribute the forces exerted upon the distributors. A housing maintains the dispensing head, first cartridge, second cartridge, first distributor, second distributor, and compensating assembly in operative relation with each other.

Upon movement of the dispensing head and housing toward each other, the compensating assembly will yield to reduce the effective stroke distance of the first distributor, whereby the first component and the second component are mixed in preselected proportion within the dispensing head to form a resultant product and the product is subsequently discharged from the dispensing head.

Accordingly, it is an object of the present invention to provide a dispensing apparatus capable of discharging two components in a fixed preselected ratio by providing means for harmonizing the strokes of the distributors, the forces exerted within the distributors, and the times and pressures of injection into the mixing space.

It is a further object of the present invention to provide a dispensing apparatus capable of discharging two components at two different start times for two different intervals of time.

It is another object of the present invention to provide a compact dispensing apparatus suitable for storing, transporting and mixing the components of a resultant product.

It is a still further object of the present invention to provide a dispensing apparatus for use in discharging medicaments intended to be prepared shortly before their use.

BRIEF DESCRIPTION OF THE DRAWINGS

FIG. 2 is a sectional view along line II—II of FIg. 1;

FIG. 3 is a sectional view along line III—III of FIG. 1;

DETAILED DESCRIPTION OF THE PREFERRED EMBODIMENTS

Figure 1:
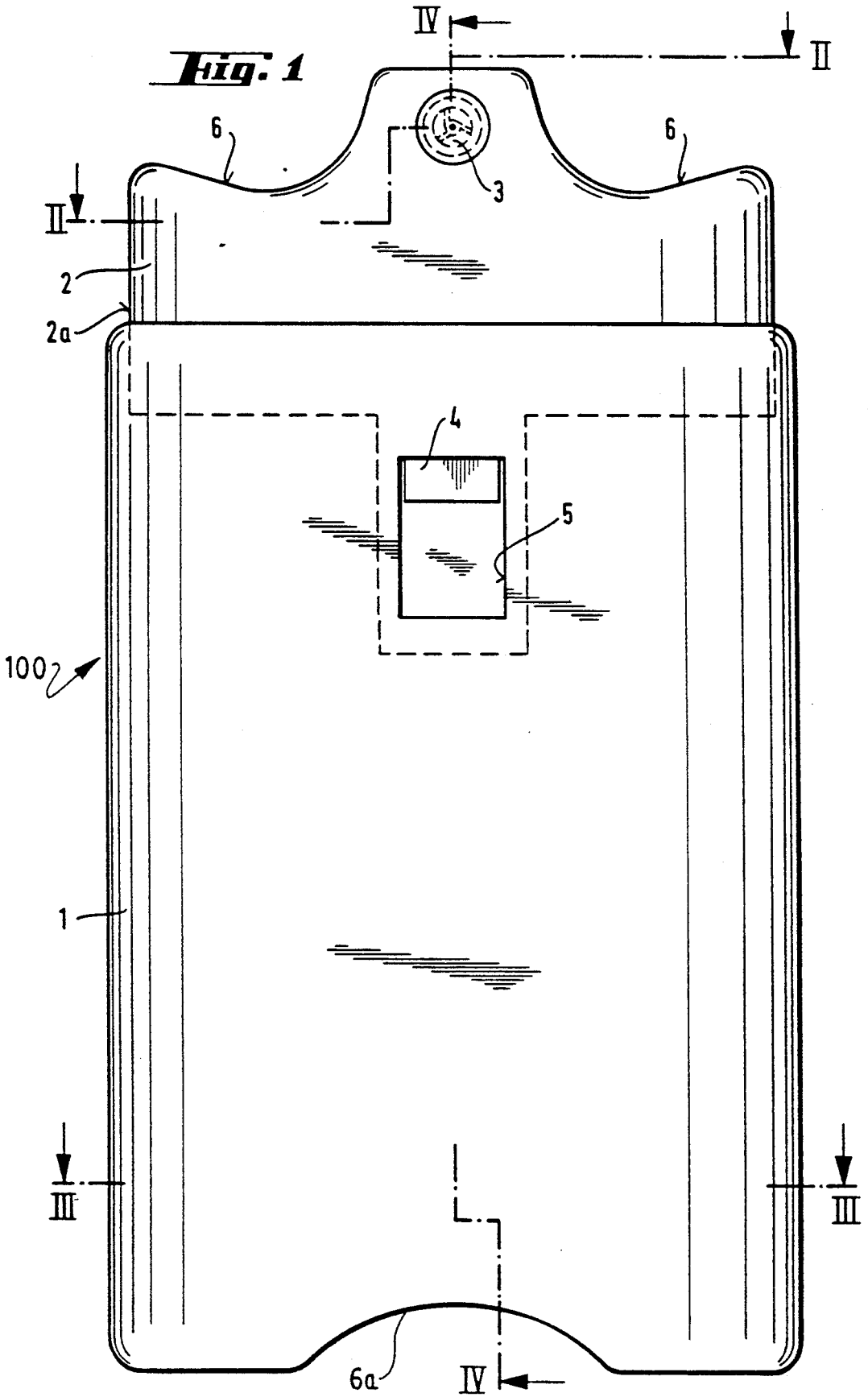
FIG. 1 is a front elevation view of the dispenser head and housing according to one embodiment of the present invention.
Figure 4:
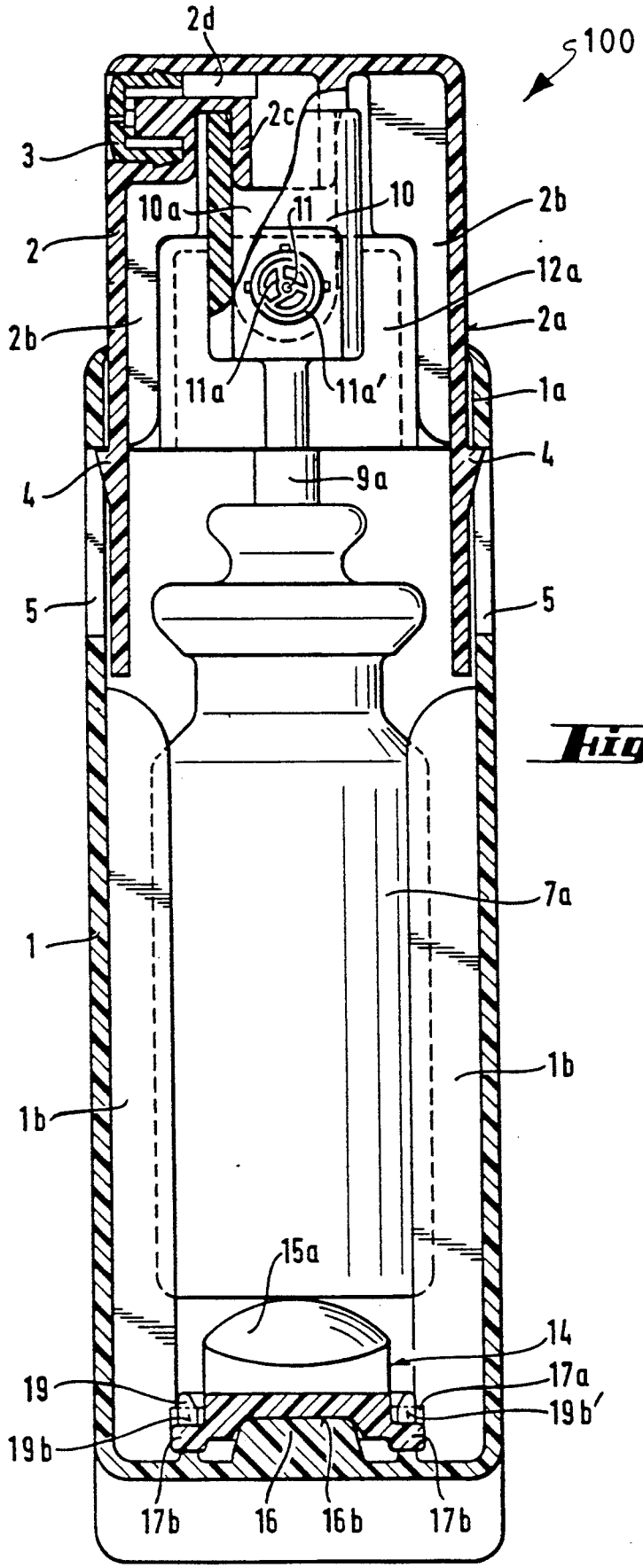
FIG. 4 is a sectional view along lien IV—IV of FIGS. 1, 2 and 3.
Figure 5:
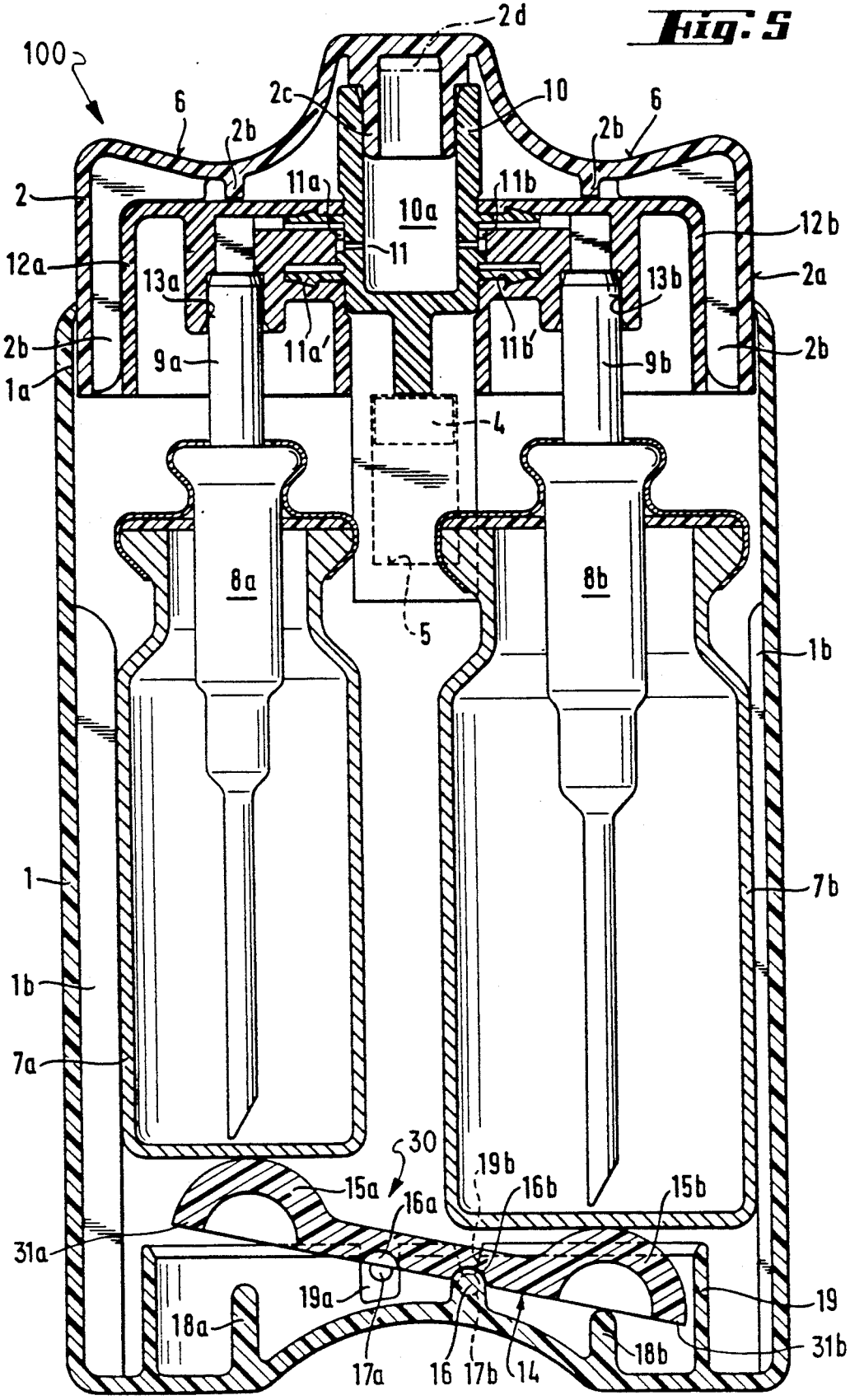
FIG. 5 is a sectional view along line V—V of FIG. 2, prior to actuation of the dispensing apparatus.
Figure 6:
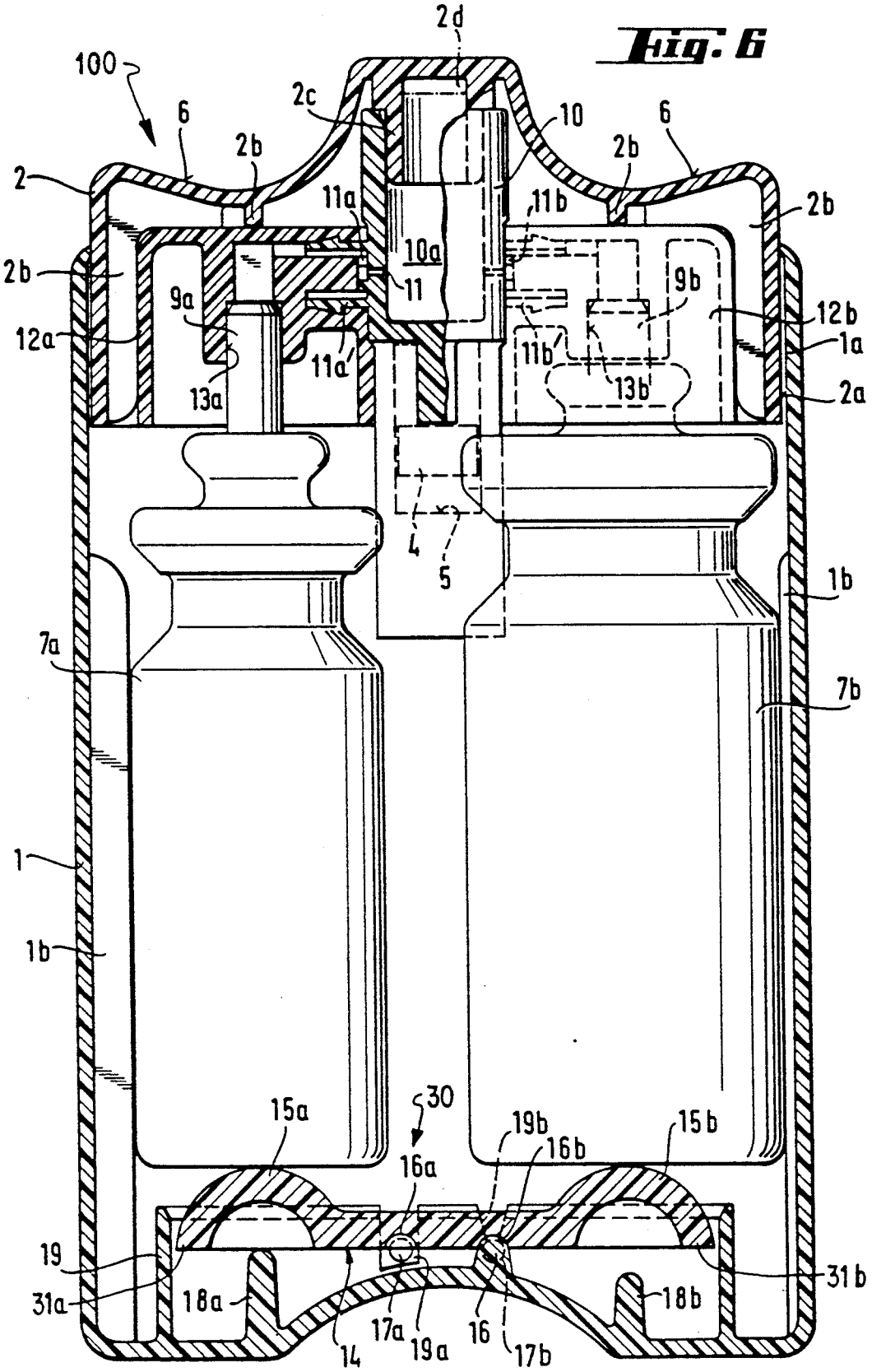
FIG. 6 is a sectional view along line V—V of FIG. 2, after actuation of the dispensing apparatus.

The dispensing apparatus 100 shown in FIG. 1 comprises an oblong cylindrical container which forms a housing 1. Housing 1 is molded from a continuous piece of plastic and the top of housing 1 is enclosed by a shell 2 of a dispensing head 1*a*. In a preferred embodiment, the dispensing head 1*a* is slideably received in housing 1 and retained on housing 1 by pawls 4 engaged beneath shoulders molded in openings 5 of housing 1. Two grooves 6 in dispensing head 1*a* and one groove 6*a* in housing 1 enable the dispensing apparatus to be held between the fingers, thereby allowing housing 1 and dispensing head 1*a* to be pressed towards each other in translatory motion to project the components of the resultant product through nozzle 3.

The dispensing apparatus 100, as shown in FIGS. 2–6, further comprises two cartridges 7*a* and 7*b* which carry corresponding pumps 8*a* and 8*b*, respectively. As a general rule, pumps 8*a*, 8*b*, and thus cartridges 7*a*, 7*b*, have different capacities, with the capacity of cartridge 7*b* being larger than the capacity of cartridge 7*a*. In a preferred embodiment, cartridge 7*a* contains the active product and cartridge 7*b* contains the excipient. Pumps 8*a*, 8*b* each have tubular piston rods or jets 9*a* and 9*b*, respectively, extending therefrom.

The dispensing head 1*a* preferably comprises a tubular casing 10 equipped with injection orifices The seats 11*a*, 11*b* of orifices 11, 11′ each contain a three-arm spiral nozzle surrounded by sockets 11*a*′, 11*b*′. The spiral nozzle insures that when the components enter mixing chamber 10*a* they do so with a swirling motion, thus facilitating their mixing. Two shoulders 12*a*, 12*b* fit on sockets 11*a*′, 11*b*′, respectively. Shoulders 12*a*, 12*b* are provided respectively, in a sealed manner to prevent leakage of components flowing from cartridges 7*a*, 7*b*.

Dispensing head 1*a* fits into shell 2, where head 1*a* can be reversibly positioned on ribs 2*b* to fit around neck 2*c*. Thus, dispensing head 1*a* comprises a single symmetrical assembly. Neck 2*c* is connected by a duct 2*d* to nozzle 3. Components from pumps 8*a*, 8*b* may be atomized at two stages. These stages are at nozzles 11, 11′ and nozzle 3.

Tubular casing 10 further comprises a mixing chamber 10*a* which preferably has a capacity equal to the sum of the capacities of pumps 8*a*, 8*b*. Mixing chamber 10*a* allows the components to be combined to form the final product on each compression of the dispensing unit. Moreover, mixing chamber 10 provides for a very thorough mixing of the components and gives them a storage time not more than the time separating separate uses of the dispensing apparatus.

Other dispensing head structures can be utilized, depending upon the products used, the mixture desired, and the acceptable losses of pump pressure. Thus, the mixing chamber 10*a* may be disposed horizontally, and it may be equipped with an air inlet supplied by oblique orifices. These orifices may further be positioned in an orientation other than diametrically opposite the sides of tubular casing 10 and, if asymmetry is acceptable, they may even be of two different sizes. Each of the orifices may also exclude the spiral nozzle used for swirling the components. Further, mixing chamber 10*a* may be reduced to a simple duct having two inlets if it is desired to achieve simultaneous discharge from the dispensing apparatus without any storage. If nozzle 3 is omitted, the head may be molded in a single piece.

Preferably, the lower portion of housing 1 supports a compensatinq assembly 30 which distributes the forces exerted on pumps 8*a* and 8*b*. Compensating assembly 30 also progressively balances the penetration of jets 9*a*, 9*b* to compensate for the stiffnesses and the strokes of pumps 8*a*, 8*b*. However, the present invention also contemplates the use of a compensating assembly 30 in other locations, for instance, between the dispensing head 1*a* and jets 9*a*, 9*b*. Compensating assembly 30 comprises lever 14 on a laterally offset fulcrum 16, and stop ribs 18*a*, 18*b*. As shown in particular in FIGS. 4, 5 and 6, the bases of vessels 7*a*, 7*b* do not rest directly on the bottom of housing 1, but instead rest on lever 14 of compensating assembly 30.

Lever 14 has a symmetrical shape and has at its ends two upper bosses 15*a*, 15*b*. Bosses 15*a*, 15*b* each have an arcuate shape. In the space between the two bosses 15*a*, 15*b* are two lower fulcrum seats 16*a*, 16*b* associated with respective trunnions 17*a*, 17*b*. Fulcrum seats 16*a*, 16*b*, and trunnions 17*a*, 17*b* create two possible pivot axes for lever 14. In the dispensing apparatus 100 as shown in the present invention, only fulcrum seat 16*b* is used; fulcrum seat 16*a* is provided so that lever 14 may be installed in either direction in housing 1 without checking on which pivot axis lever 14 hinges.

The walls of housing 1 have integral ribs 1*a*, 1*b* which are adapted for guiding and maintaining cartridges 7*a*, 7*b* in proper position within housing 1. The base of housing 1 also carries two stop ribs 18*a*, 18*b* and single fulcrum 16 on which rests seat 16*b* of lever 14. The base of housing 1 has an integral upstanding skirt 19. Skirt 19 has two grooves 19*a*, 19*a*′ which allow free passage to the trunnion 17*a*, and two notches 19*b*, 19*b*′ which form retaining catches for trunnion 17*b*. Thus, in the described embodiment, lever 14 is articulated through fulcrum seat 16*b* and trunnion 17*b*, on an axis offset toward larger cartridge 7*b*.

After lever 14 has been placed in position, to assemble and use the dispenser of the present invention it is only necessary to install cartridges 7*a*, 7*b*, and then fit seatings 13*a*, 13*b* onto jets 9*a*, 9*b* and dispensing head 1*a* onto housing 1 until pawls 4 of dispenser head 1*a* snap into engagement with openings 5 of housing 1. Ribs 1*a* and 1*b* insure proper positioning of cartridges 7*a*, 7*b*, i.e, that larger cartridge 7*b* is in position closer to fulcrum 16. When installed, cartridge 7*b* causes a shorter arm 31*b* of lever 14 to come into abutment on rib 18*b*, and it causes cartridge 7*a* to be supported by a longer arm 31*a* of lever 14.

Housing 1 and dispensing head 1*a* are moveable relative to each other. Springs (not shown) inside pumps 8*a*, 8*b* tend to push dispensing head 1*a* away from and off housing 1, while pawls 4 engaged in openings 5 maintain dispensing head 1*a* in position on housing 1. When the operator presses housing 1 and dispensing head 1*a* toward each other between his fingers, parallel to the axis of cartridges 7*a*, 7*b*, this force bears indirectly on lever 14, acting at the position of fulcrum 16. Lever 14 therefore forms a balancing table having unequal arms 31*a* and 31*b* which pivots on the base of housing 1. Arms 31*a*, 31*b* distribute the force exerted on fulcrum point 16 in a ratio inverse to that of the length of arms 31*a*, 31*b* to vary and distribute the force to the base of cartridges 7*a*, 7*b*. Further, while arms 31*a*, 31*b* do not directly govern the strokes of pumps 8*a*, 8*b*, within the limits of the tilting of lever 14, arms 1*a*, 31*b* do balance the penetration of jets 9a, 9b by modifying the ratio of the strokes of pump 8a, 8b.

In operation, when a sufficient amount of compressive force is applied to move housing 1 and dispensing head 1a toward each other, the force acts through lever 14 and bosses 15a, 15b to the bottom of cartridges 7a, 7b. Lever 14 balances the compressive force applied, and since arm 31b is shorter than arm 1a, the reactive force at 15b is greater than the reactive force at 15a. Thus, the spring in pump 8b will yield before the spring in pump 8a, if their respective forces at rest are about the same, and pump 8b will being discharging the component stored in cartridge 7b. Accordingly, lever 14 will begin to tilt. The spring in pump 8a will then yield and pump a will begin to discharge the component stored in cartridge 7a while lever 14 continues to tilt. The time period between the beginning of discharge of component by pump 8b and the beginning of discharge of component by pump 8a may be chosen by properly selecting the lengths of arms 31a, 31b and stiffnesses of the springs in pumps 8a, 8b.

As soon as pumps 8a, 8b begin simultaneously discharging the components stored in vessel 7a, 7b, lever 14 begins to tilt more slowly. This tilting causes a change in the relative positioning of cartridges 7a, 7b, and this causes the effective stroke distances of pumps 8a, 8b to change.

Finally, pump 8a reaches the end of its stroke and stops discharging component stored in cartridge 7a. At this time, pump 8b again operates alone to sweep mixing chamber 10a until dispensing apparatus 100 reaches the end of its travel. The compressive force is then released, thereby restoring dispensing apparatus 100 and its components to their initial positions.

Thus, by way of nonlimiting example, the dispensing apparatus of the present invention may include pumps 8a, 8b which have respective constructive strokes of 2 mm and 6 mm and respective internal diameters of 5 mm and 6.5 mm. Thus, the ratio of strokes is 3:1, the ratio of internal cross-sectional areas is 1.7:1, and the ratio of volumes is 5:1. Further, the springs of pumps 8a, 8b may be assumed to have been initially compressed 1.0 mm and 1.67 mm, respectively. This compression translates to forces that range from 4 and 5 N (newtons), respectively, (a ratio of 1.25:1), when at rest to obtain the desired seal, to 12 and 23 N, respectively, (ratio of 1.91:1), at the end of the stroke. These values correspond to spring stiffnesses of 4 and 3 N respectively.

If it is desired to obtain atomization pressures of the components stored in cartridges 7a, 7b, of approximately 4 bars and if friction values are estimated to be approximately 3 N, then the necessary thrust forces that must be applied to cartridges 7a, 7b and to pumps 8a, 8b will approximately range from 15 and 22 N, respectively, (a ratio of 1.47:1), to 23 and 40 N, respectively, (ratio of 1.74:1).

If fulcrum 16 is placed closer to cartridge 7b, so as to make the ratio of longer arm 31b to smaller arm 31a equal to 1.5:1, then the resistance of the spring in pump 8b, which contains the excipient, will be the first to be overcome under a compressive force applied by the operator slightly exceeding 30 N. The spring in pump 8b is overcome first because of the greater reactive force exerted by boss 15b on cartridge 7b, and once the resistance of the spring in pump 8b is overcome, lever 14 will begin to tilt.

Pump 8b will operate for a stroke of approximately 0.4 mm. The resistance of pump 8b progressively increases and, once pump 8b has discharged a given amount of excipient, lever 14 will continue to tilt and balance the forces applied to in pump 8a will be overcome and pump 8a will begin to discharge the active product synchronously with the discharge of excipient.

The ratio of the strokes of pumps 8a, 8b during this phase of synchronous operation is represented by the product of the lever arm ratio and the stiffnesses of the springs in pumps 8b, 8a, i.e., $(3/2)\times(3/4)=2:1$. Thus, during the phase of synchronous operation, the stroke of pump 8b is twice the stroke of pump 8a, i.e., 4 mm and 2 mm, respectively.

Lever 14 then tilts more slowly until pump 8a arrives at the end of its stroke, causing pump 8b to operate alone for a stroke of 1.6 mm. Lever 14 then stops tilting and the dispensing apparatus arrives at the end of its travel. Thus, the difference in the strokes of pumps 8a, 8b is provided by the tilting of lever 14 which causes cartridge 7a to recoil, accordingly reducing the stroke that dispensing head 1a would have imparted to pump 8a if lever 14 did not tilt. Thus, pump 8a will discharge component for a total effective stroke of 2 mm and pump 8b will discharge component for a total effective stroke of 6 mm.

Therefore, pump 8a is the first to arrive at the end of its stroke under a force exerted by the operator of slightly less than 70 N, followed by the second pump. In practice, a constant force of 50 N will lead to correct functioning of dispensing apparatus 100.

Accordingly, the longer arm to shorter arm ratio (i.e., 1.5:1) must lie between the respective ratios of extreme forces to be experienced by pumps 8a, 8b during operation (i.e., 1.25:1 to 1.91:1). However, due to friction and back pressure, it is advantageous to choose between the thrust force ratios (i.e., 1:47:1 to 1:74:1). In general, lever arm ratios that vary between 1.2 and 1.8, and preferably vary between 1.4 and 1.6, provide for acceptable operation of the dispensing apparatus of the present invention. It is advantageous to reduce these ratio ranges to the extent made possible by manufacturing tolerances, particularly if the delivery of the mixed product requires only a small volume mixing chamber.

If the ratio of lever arms 31a, 31b is taken outside the above limits, the sequence of functioning and the duration of the synchronous phase of the dispensing apparatus of the present invention would be changed. An increase in the ratio of lever arms 31a, 31b retards the functioning of pump 8a relative to the functioning of pump 8b, and a decrease in the lever arm ratio advances the functioning of pump 8a relative to the functioning of pump 8b. A maximum ratio of lever arms equal to about 1.8:1 leads to injecting only active component from cartridge 7a into mixing chamber 10a at the end of a dispensing stroke.

If cartridges 7a, 7b have a flat base, bosses 15a, 15b could be cylindrical. If precisely synchronous flow rates are required, the ratio of the lever arms in the present example would have to vary gradually from 1.47:1 to 1.74:1. In the drawings, the ratio of the distances from the vertical of fulcrum 16 to the contact points of cartridges 7a, 7b does not vary because bosses 15a, 15b are cylindrical. However, by modifying or progressively varying the curvatures of bosses 15a, 15b, the equilibrium rule of lever 14 would be modified, thereby changing the flow rates from cartridges 7a, 7b due to the evolution of the ratio of arms 31a, 31b.

In utilizing the present invention, the "lost" or "dead" volume created by the reverse motion of the internal mechanisms of pumps 8*a*, 8*b* at the end of the dispensing stroke must be taken into consideration. On most pumps, the orifice of the jet is closed by a sliding sleeve. This creates a play which, to calculate the useful travel, must be deducted from the total travel. These dead volumes may be over approximately 1 $mm^3$. Thus, for example, two pumps of 5.5 mm internal diameter for stroke distances of 2.2 and 6.6 mm supply respective doses of 28 and 135 μl.

Thus, by preselecting the position of fulcrum 16 of lever 14 in accordance with the stiffnesses and stroke distances of pumps 8*a*, 8*b*, the duration of simultaneous discharge of component from cartridges 7*a*, 7*b* can be controlled. More specifically, the dispensing apparatus 100 could be designed to cause cartridge 7*a* to cease discharging the component contained therein either before or after cartridge 7*b* ceases to discharge the component contained therein.

Since the respective start and stop times of pumps 8*a*, 8*b* are known, the amount of components discharged from cartridges 7*a*, 7*b* during the strokes of pumps 8*a*, 8*b* may be chosen by preselecting the internal diameters of pumps 8*a*, 8*b*. Thus, the desired ratio of components discharged from cartridges 7*a*, 7*b* may be also be controlled.

Accordingly, it is apparent that there are four different factors which may be varied to control the sequences, durations, rates and proportions at which the components are discharged: (1) the lengths of the strokes of pumps 8*a*, 8*b*, (2) the cross-sections of the internal diameters of pumps 8*a*, 8*b*, (3) the stiffnesses of the springs in pumps 8*a*, 8*b*, and (4) the lengths of arms 31*a*, 31*b*.

Finally, a device similar to the dispensing apparatus of the present invention could be used for adjusting the operation of a dispenser having two identical containers. Also, the disclosure hereinabove can be applied to an embodiment wherein the dispensing apparatus 100 would not employ pumps, but would instead use metering valves of different strokes and volumes.

Figure 7:
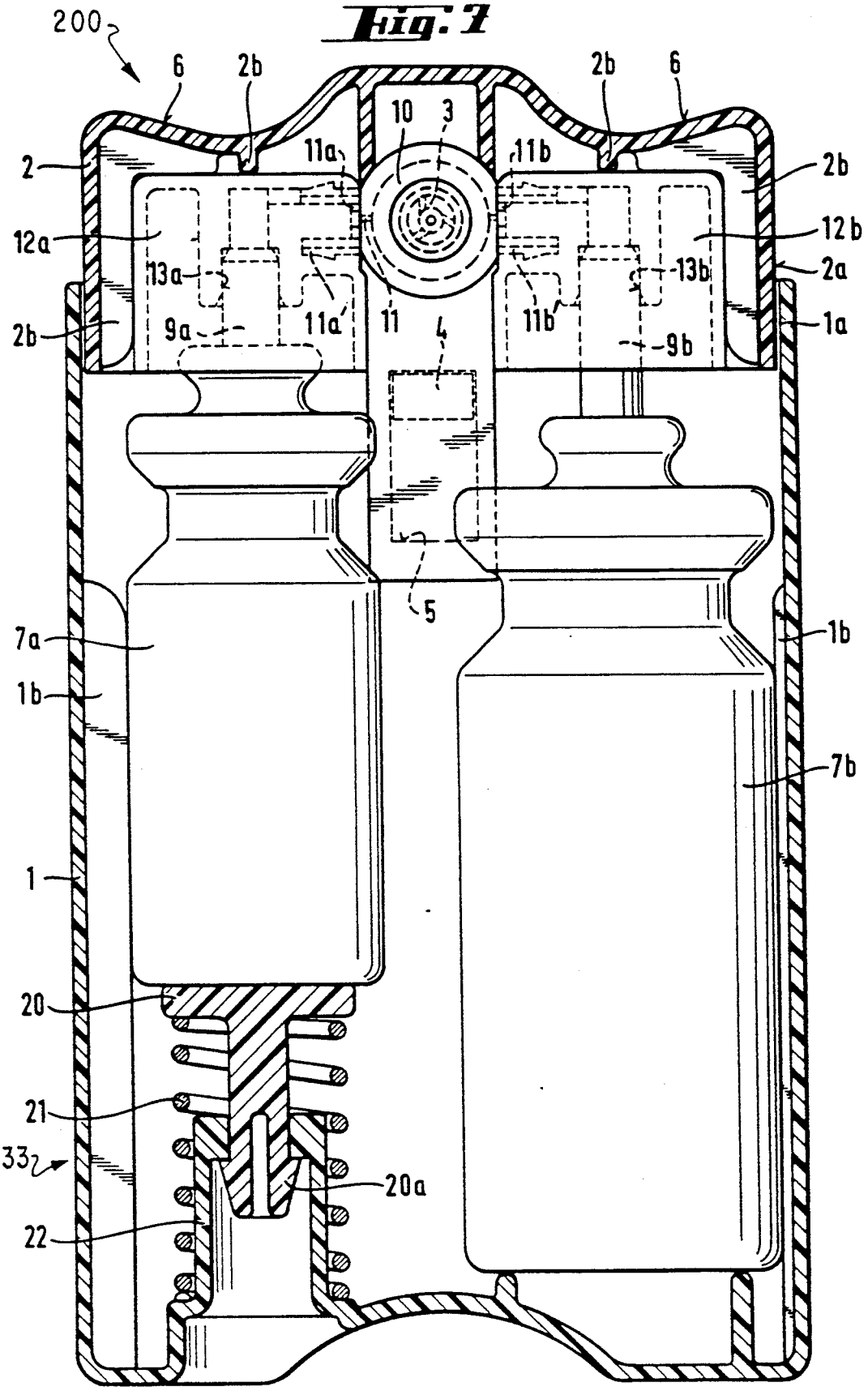
FIG. 7 is a view, partially in section, of an alternate embodiment of the dispensing apparatus of the present invention.

A second embodiment 200 of the dispensing apparatus of the present invention is illustrated in FIG. 7. It should be understood that many features of the embodiment illustrated in FIG. 7 correspond to similar features illustrated in FIGS. 1 though 6 and discussed hereinabove in detail; such similar features retain the same identifying numbers.

The compensating member 33 of the second embodiment 200 comprises a small plate 20 which is pushed against cartridge 7*a* by spring 21. Spring 21 is maintained in position by rod 20*a*, which is slideably received in post 22. Post 22 is formed integrally with housing 1.

In the second embodiment, spring 21 has substantially identical properties to those of the spring in pump 8*a*, and is substantially equally compressed at the start of the pumping cycle. Thus, when dispensing head lb acts at the same time on both jets 9*a* and 9*b*, spring 20 and the spring in pump 8*a* will yield equally under the force and the stroke of pump 8*a* will therefore be reduced by one half as compared to the stroke of pump 8*b*.

Figure 8:
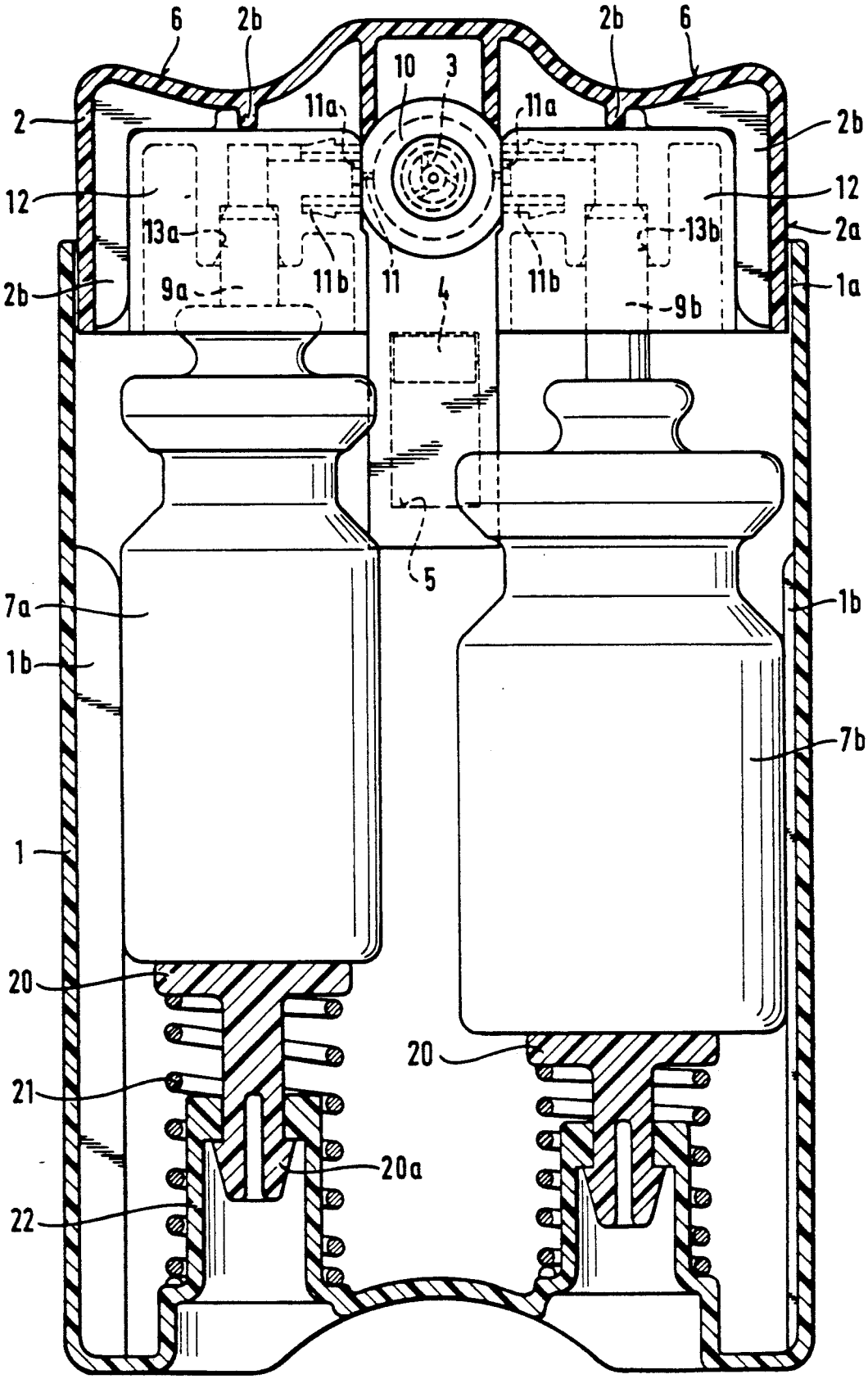
FIG. 8 is a view, partially in section, of yet another embodiment of the dispensing apparatus of the present invention.

In the second embodiment, the operation of pump 8*b* is "normal" and the balancing depends only on the choice of the two springs associated with cartridge 7*a*. Therefore, there are fewer possibilities of adjustment of the injection sequence of the two components. This second embodiment would require, in order to provide the same theoretical flexibility in use, a double member which comprises a spring beneath each of cartridges 7*a*, 7*b*. Thus, due to the tolerances of the springs, the second embodiment would work less precisely than the first embodiment. This is shown in FIG. 8.

We claim:

1. An apparatus for storing and mixing componnts for forming a product and dispensing the resultant product, said apparatus comprising:

a dispensing head;

a first cartridge for storing a second fluid component;

a second cartridge for storing a second fluid component, both said first and said second cartridges having a first open end and a second closed end;

a first manually actuated distributor providing fluid communication between said first cartridge open end and said dispensing head;

said second manually actuated distributor providing fluid communication between said second cartridge open end and said dispensing head, both said first and said second distributors having a preselected effective stroke distance;

a compensating assembly for modifying the stroke of one distributor relative to the other; and a housing for maintaining, respectively, said dispensing head, first cartridge, second cartridge, first distributor, second distributor, and compensating assembly in operative relation with each other;

whereby upon movement of said dispensing head and said housing toward each other, said compensating assembly will yield to reduce the effective stroke distance of said first distributor;

whereby said first component and said second component are mixed in a preselected proportion within said dispensing head to form a resultant product and said resultant product is subsequently discharged from said dispensing head.

2. The apparatus of claim 1 wherein said compensating assembly is located in abutting relation with the closed end of both said first cartridge and said second cartridge, said closed end of each said cartridge being located opposite said open end thereof.

3. The apparatus of claim 1 wherein the effective stroke distance of said first distributor is different than the effective stroke distance of said second distributor so as to regulate the amount of fluid component discharged from said first cartridge and said second cartridge.

4. The apparatus of claim 1 wherein said first distributor comprises a first spring with a first stiffness and said second distributor comprises a second spring with a second stiffness, said first stiffness being different than said second stiffness in a ratio greater than 1, whereby the sequence of operation and the duration of synchronous operation of said first distributor and said second distributor is controlled by varying the difference between said first stiffness and said second stiffness.

5. The apparatus of claim 1 wherein said preselected stroke of said first distributor is different than said preselected stroke of said second distributor, whereby the composition of resultant product discharged from said apparatus is controlled by varying the proportion between said stroke of said first distributor and said stroke of said second distributor through said compensating assembly.

6. The apparatus of claim 2 wherein said compensating assembly comprises a lever positioned on a fulcrum offset from the center of said lever, thereby providing said lever with a longer lever arm and a shorter lever arm.

7. The apparatus of claim 6 wherein said second cartridge has a larger capacity than said first cartridge and whereins aid fulcrum of said lever is offset toward said second cartridge, thereby causing said shorter lever arm to contact said second cartridge.

8. The apparatus of claim 6 wherein said first distributor comprises a pump having a first spring and said second distributor comprises a pump having a second spring, wherein said first spring and said second spring have preloaded minimum values and loaded maximum values of force, and wherein a ratio of said minimum forces on said springs and a ratio of said maximum forces on said springs establish a range of ratios; wherein the length of said longer lever arm to that of said smaller lever arm forms a lever arm ratio falling within said range.

9. The apparatus of claim 8 wherein said first pump and said second pump each have a preselected stroke distance and wherein said first spring and said second spring each have a preselected stiffness, wherein the stiffness of said second spring is less than the stiffness of said first spring in a ratio less than 1, and wherein the product of said ratio of lever arms and of said ratio of stiffnesses is approximately equal to the ratio of said stroke of said first pump and said stroke of said second pump during synchronous operation of said first pump and said second pump.

10. The apparatus of claim 6 wherein said first and said second distributors are pumps, and wherein said lever comprises two upper bosses in abutting relation with the closed portion of, respectively, said first cartridge and second cartridge; each said boss having a progressive variation in curvature so as to balance a force applied to each said pump due to compression of said dispensing head and said housing toward each other.

11. The apparatus of claim 6 wherein said lever symmetrically comprises two lower fulcrum points one to engage said fulcrum and two upper bosses, each said boss having an arcuate shape.

12. The apparatus of claim 1 wherein said dispensing head comprises a tubular casing having a first injection orifice, a second injection orifice, and a nozzle for dispensing said product from said apparatus; wherein said first injection orifice provides fluid communication between said tubular casing and a first shoulder located in contact relation with said first distributor, and wherein said second injection orifice provides fluid communication between said tubular causing and a second shoulder located in contact relation with said second distributor, wherein said first shoulder engages said first distributor and said second shoulder engages said second distributor, such that upon movement of said dispensing head toward said housing, said first shoulder causes said first distributor to discharge said component stored in said first cartridge through said first injection orifice into said tubular casing and said second shoulder causes said second distributor to discharge said component stored in said second cartridge through said second injection orifice into said tubular casing, whereby said components are combined to form a resultant product which is thereafter discharged from said apparatus through said nozzle.

13. The apparatus of claim 12 wherein at least one of said first injection orifice and said second injection orifice comprises a spiral-shaped opening to create a swirling movement in, respectively, said first component and said second component.

14. The apparatus of claim 12 wherein said first injection orifice and said second injection orifice are each in fluid communication with a mixing chamber formed within said tubular casing.

15. The apparatus of cliam 14 wherein said mixing chamber has a capacity equal to the combined capacity of said first distributor and said second distributor.

16. An apparatus for storing and mixing components for fomring a product and dispensing the resultant product, said apparatus comprising:

a dispensing head;

a first cartridge for storing a first fluid component;

a second cartridge for storing a second fluid component, both said first and said second cartridges having a first open end and a second closed end;

a first distributor providing fluid communication between said first cartridge open end and said dispensing head;

a second distributor providing fluid communication between said second cartridge open end and said dispensing head, both said first and said second distributors having a preselected effective stroke distance;

a first compensating member for modifying the stroke of one distributor relative to the other positioned beneath said first cartridge;

a housing for maintaining, respectively, said dispensing head, first cartridge, second cartridge, first distributor, second distributor, and first compensating member in operative relation with each other, whereby upon movement of said dispensing head and said housing toward each other, said compensating member will yield to reduce the effective stroke distance of said first distributor;

whereby said first component and said second component are mixed in a preselected proportion within said dispensing head to form a resultant product and said resultant product is subsequently discharged from said dispensing head.

17. The apparatus of claim 16 whereins aid compensating member comprises a plate maintained in abutting relation withs aid closed bottom portion of said first cartridge by a spring, and wherein said plate and said spring are maintained in position by a post which forms part of a base portion of said housing.

18. The apparatus of claim 17 wherein said first distributor comprsies a spring and wherein said spring in said compensating member and said spring in said first distributor have substantially identical properties and are substantially equally compressed at the start of a pumping cycle.

19. The apparatus of claim 16 wherein said apparatus further comprises a second compensating member positioned in abutting relation with the closed bottom portion of said second cartridge.

20. The apparatus of claim 19 wherein said second compensating member comprises a plate maintained in abutting relation with said second cartridge by a spring, and wherein said plate and said spring are maintained in position by a post which forms part of a base portion of said housing.

21. The apparatus of claim 20 wherein said second distributor comprises a spring and wherein said spring in said second compensating member and said spring in said second distributor have substantially identical properties and are substantially equally compressed at the start of a pumping cycle.

22. An apparatus for storing and mixing components for forming a product and dispensing the resultant product, said apparatus comprising:

a dispensing head;

a first cartridge for storing a second fluid component;

a second cartridge for storing a second fluid component, both said first and said second cartridges having a first open end and a second closed end;

a first distributor providing fluid communication between said first cartridge open end and said dispensing head;

a second distributor providing fluid communication between said second cartridge open end and said dispensing head, both said first and said second distributors having a preselected effective stroke distance;

a compensating assembly for modifying teh stroke of one pump relative to the other; and a housing for maintaining, respectively, said dispensing head, first cartridge, second cartridge, first distributor, second distributor, and compensating assembly in operative relation with each other;

whereby upon movement of said dispensing head and said housing toward each other, said compensating assembly first causes said second component to be discharged into said dispensing head, and then causes said first component to be discharges into said dispensing head;

whereby said first component and said second component are mixed in a preselected proportion for a preselected duration in said dispensing head and subsequently discharged from said dispensing head.

23. An apparatus for storing and mixing components for forming a product and dispensing the resultant product, said apparatus comprising:

a dispensing head;

a first cartridge for storing a second fluid component;

a second cartridge for storing a second fluid component, both said first and said second cartridges having a first open end and a second closed end;

a first pump providing fluid communication between said first cartridge open end and said dispensing head;

a second pump providing fluid communication between said second cartridge open end and said dispensing head, both said first and said second distributors having a preselected effective stroke distance;

a compensating assembly for modifying the stroke of one pump relative to the other; and a housing for maintaining, respectively, said dispensing head, first cartridge, second cartridge, first pump, second pump, and compensating assembly in operative relation with each other;

whereby upon the application of a compressive force to move said dispensing head and said housing toward each other, said compensating assembly will yield, thereby adjusting the effective stroke distance of said first pump and said second pump, whereby said first component and said second component are mixed in preselected proportions within said dispensing head to form a resultant product and said resultant product is subsequently discharged from said dispensing head.

24. A method for storing and mixing components for forming a product and dispensing the resultant product thus produced, said method comprising:

at least partially filling a first cartridge with a first fluid component;

at least partially fililng a second cartridge with a second fluid component;

attaching a first distributor to said first cartridge, said first distributor comprising a first spring and having a first preselected effective stroke distance;

attaching a second distributor to said second cartridge, said second distributor comprising a second spring and having a second preselected effective stroke distance;

positioning said first cartridge and said second cartridge within a housing in abutting relation with a compensating assembly located therein, wherein said compensating assembly comprises a lever positioned on a fulcrum offset from the center of said lever, thereby providing said lever with a longer lever arm and a shorter lever arm;

enclosing said first cartridge, said second cartridge, said first distributor, said second distributor, and said compensating assembly within said housing with a dispensing head;

applying a compressive force to move said dispensing head and housing toward each other, thereby causing said shorter lever arm to first cause said second distributor to discharge a preselected amount of said second component into said dispensing head, and then causing said longer lever arm to cause said first distributor to discharge a preselected amount of said first component into said dispensing head;

wherein said first component and said second component are thereby discharged in a preselected proportion for a preselected duration into said dispensing head to form a resultant product which is subsequently discharged from said dispensing head.

25. The method of claim 24, which further comprises balancing said compressive force about said fulcrum into reactive forces at said shorter lever arm and said longer lever arm and thus applying said reactive forces to said second distributor and said first distributor in inverse proportion to the length of said shorter lever arm and said longer lever arm.

26. The method of claim 24 which further comprises tilting said compensating member in response to said compressive force to adjust said effective stroke distance of said first distributor and said effective stroke distance of said second distributor to govern the sequence of functioning and the duration of synchronous functioning of said first distributor and said second distributor.

27. The method of claim 24 which further comprises distributing said compressive force about said fulcrum to govern the sequence of functioning and the duration of synchronous functioning of said first distributor and said second distributor.

28. The method of claim 24 which further comprises controlling the sequence of functioning and the duration of synchronous functioning of said first distributor and said second distributor by varying the length of said longer lever arm with respect to the length of said shorter lever arm.

29. The method of claim 24 wherein the stiffness of said first spring is different than the stiffness of said second spring, which further comprises controlling the sequence of functioning and the duration of synchronous functioning of said first distributor and said second distributor by varying the length of said longer lever arm with respect to the length of said shorter lever arm and varying said stiffness of said first spring with respect to said stiffness of said second spring.

* * * * *